United States Patent [19]

Jepson et al.

[11] 4,040,167

[45] Aug. 9, 1977

[54] METHOD OF AND A MACHINE FOR SEPARATING AND FITTING INSULATED CONDUCTORS OF MULTI-CONDUCTOR RIBBON CABLES TO CONNECTORS IN HOUSINGS

[75] Inventors: Michael John Jepson, Stapleford; Bernard Kilbourne, Breaston, both of England

[73] Assignee: The Breedon Press Limited, Long Eaton, United Kingdom

[21] Appl. No.: 644,587

[22] Filed: Dec. 29, 1975

[51] Int. Cl.[2] ..... H01R 43/04

[52] U.S. Cl. ..... 29/564.4; 29/628; 29/752

[58] Field of Search ..... 29/33 M, 628, 461, 203 C, 29/203 D, 203 DT, 203 MW, 564.1, 564.4, 564, 749, 752

[56] References Cited

U.S. PATENT DOCUMENTS

| | | | |
|---|---|---|---|
| 3,774,284 | 11/1973 | Cootes | 29/203 C |
| 3,836,415 | 9/1974 | Hilderbrandt | 29/203 MV |
| 3,875,662 | 4/1975 | Folk | 29/203 DT |
| 3,891,013 | 6/1975 | Folk et al. | 29/203 DT |
| 3,909,900 | 10/1975 | Gudmestad | 29/564.4 |

*Primary Examiner*—Othell M. Simpson
*Attorney, Agent, or Firm*—Hans Berman

[57] ABSTRACT

Automatic apparatus for fitting a multi-conductor ribbon cable with individual contacts or connectors in which the cable is passed endways between cutting or tearing elements to separate the conductors in the leading cable end, cutting the insulation of each conductor transversely and removing the unwanted terminal insulation portions from the stationary cable, placing a housing carrying suitably positioned contacts over the bare individual conductors, gang-crimping the contacts over the respective conductors.

8 Claims, 19 Drawing Figures

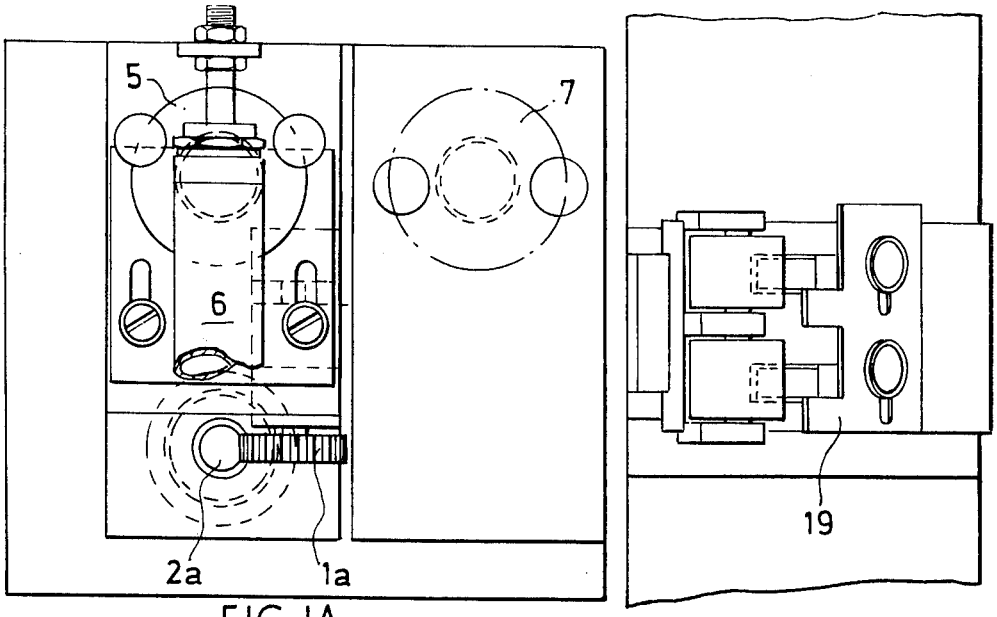
FIG. 1A.
FIG. 2.
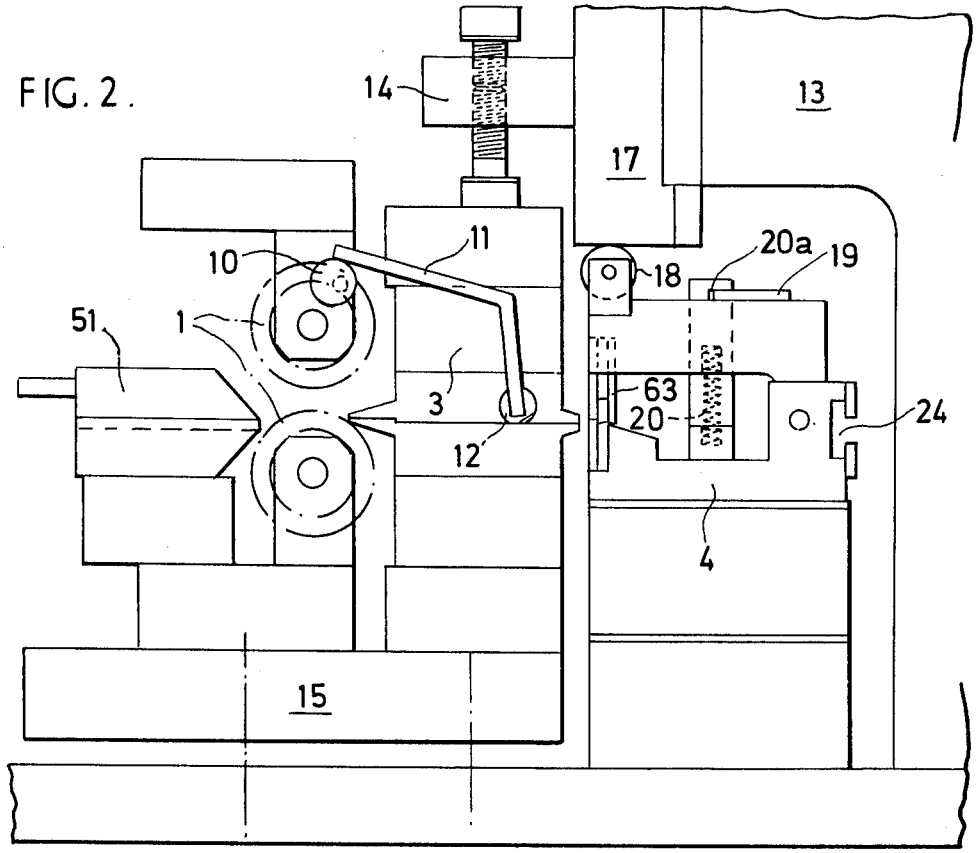

FIG. 3.
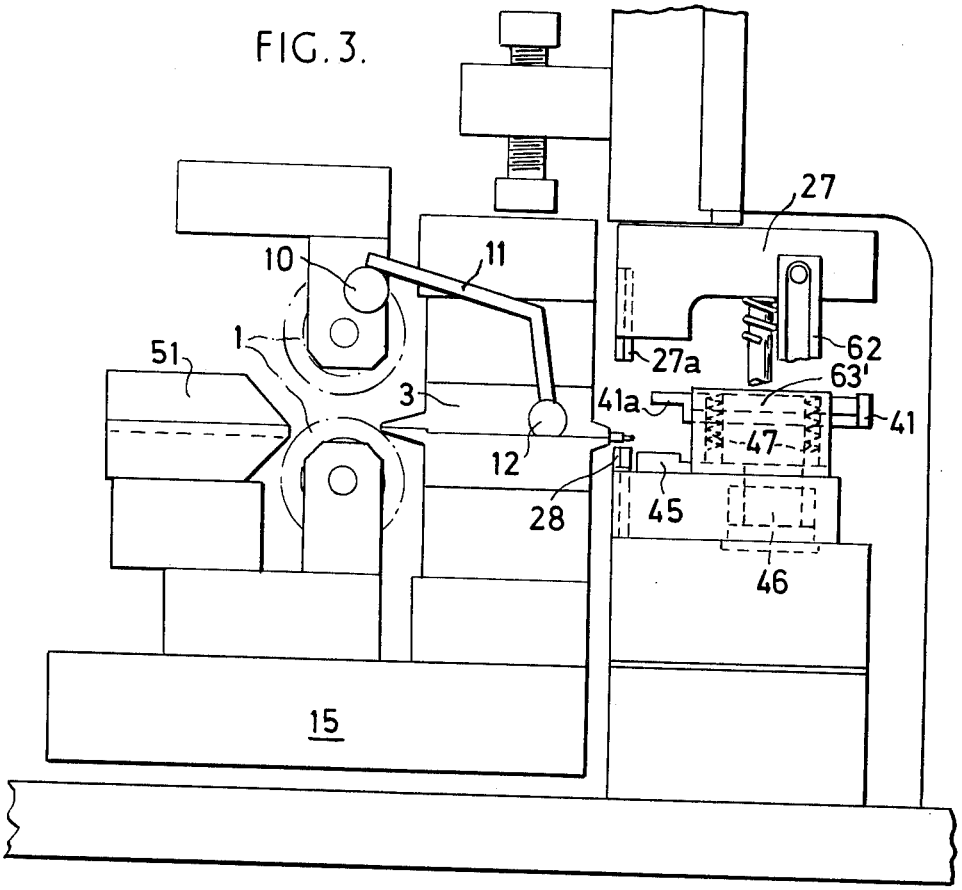
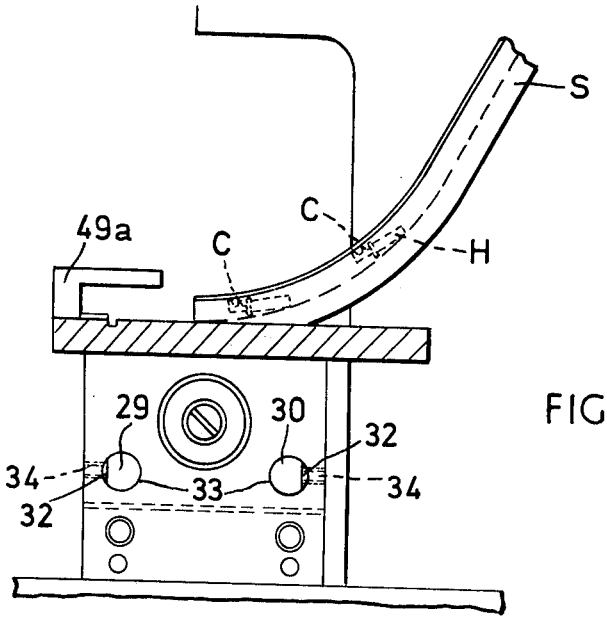
FIG. 6.

METHOD OF AND A MACHINE FOR SEPARATING AND FITTING INSULATED CONDUCTORS OF MULTI-CONDUCTOR RIBBON CABLES TO CONNECTORS IN HOUSINGS

This invention relates to a machine for separating and fitting insulated conductors of multi-conductor ribbon cables to contacts or connectors (referred to hereinafter simply as contacts) in housings and has for its primary object the provision of a method of and a machine for automatically and expeditiously separating integrally formed side-by-side individual insulated conductors of multi-conductor ribbon cables, stripping the insulation from the ends of said conductors and "gang-crimping"- the contacts pre-assembled in a housing of an electric fitting, to the bared ends of said conductors.

The invention provides a machine for performing the above operations which broadly comprises in combination an entry channel for receiving and guiding the multi-conductor ribbon cable, cutting or tearing elements for separating the ribbon lengthways at its leading end into individual insulated conductors, means for feeding the said separated conductors forwardly through a collecting and spreading device, means for moving the cutting or tearing elements out of engagement with the ribbon and simultaneously actuating and causing a gripping device to bear on the separated and spread conductors and hold them stationary while locating them in a cropping and stripping device for baring the leading ends of the conductors, and means for successively feeding housings containing contacts to a position for receiving the bared ends of the conductors, and means for "gang-crimping"the contacts to said bared ends of the conductors, and means for engaging the contacts with the fitted conductors fully in said housings from preliminary positions in which they are initially and temporarily located for receiving the bared ends of the conductors.

To enable the invention to be clearly understood a preferred embodiment thereof will now be described by way of example with reference to the accompanying purely diagrammatic drawings, wherein:

FIG. 1A is a plan view of part of FIG. 1.

FIG. 2 is a view similar to FIG. 1 but showing elements of the cutting device out of engagement; a conductor-gripping device actuated and the crop and strip device closed.

FIG. 3 is a view similar to FIG. 2 but showing a gang crimping mechanism, for simultaneously crimping a number of contacts to the bared ends of the conductors.

FIG. 6 is an end view of FIG. 4.

Figure 1:
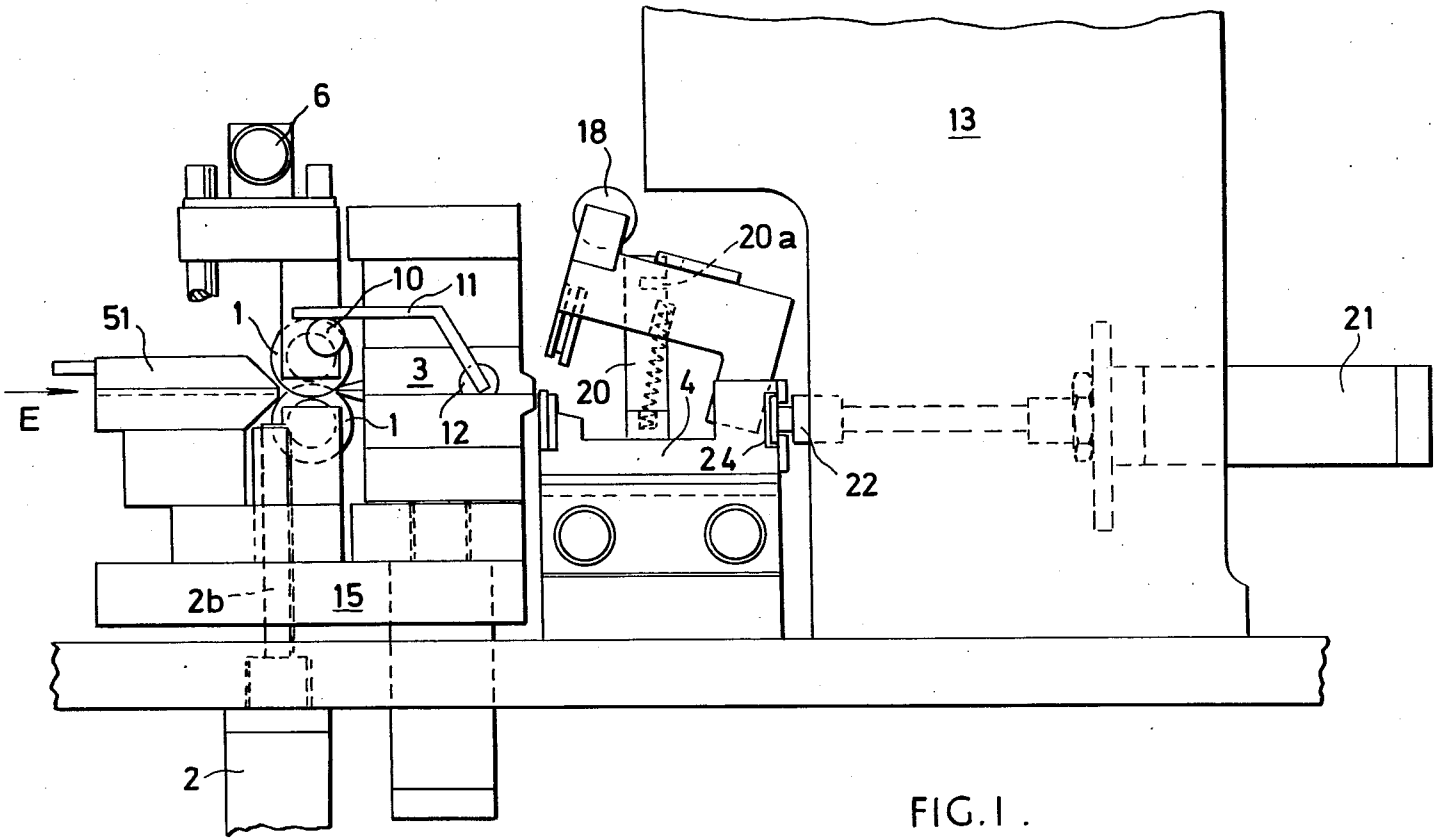
FIG. 1 is a side view of the part of the machine comprising the ribbon entry or guide channel, cutting or tearing elements, spreader mechanism and the insulation crop and strip device shown in an open position.

Referring firstly to FIGS. 1 to 3 of said drawings, the machine comprises an entry channel or guide 51 for the cable R, a pair of cutting or tearing rollers 1 between which is passed a multi-conductor ribbon calbe R introduced into the machine at E, the cutting rollers 1 acting to separate side-by-side individually insulated conductors of the cable. These rollers 1 are driven by meshing pinions 1*a* at their ends and which are driven by a rack 2*a* forming part of a ram 2*b* reciprocated vertically in a fluid power cylinder 2, the stroke of the ram 2*b* determining the length of ribbon separated lengthways between the individually insulated conductors.

Figure 10:
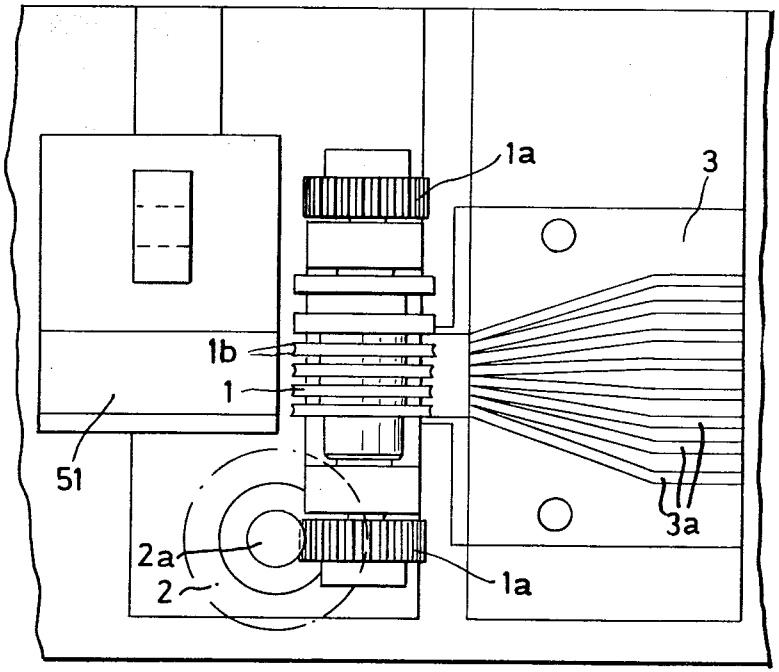
FIG. 10 is a part plan view of the conductor separator device and spreader mechanism.
Figure 9A:
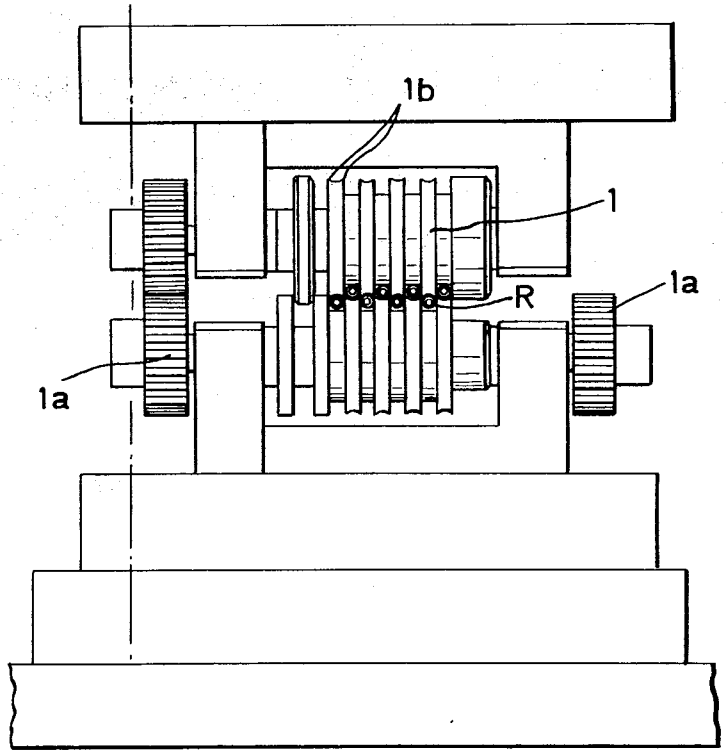
FIG. 9A is a view similar to FIG. 9 but showing the cutting or tearing device closed and the conductors of a ribbon cable separated.

The longitudinally separated part of the ribbon R passes from between the cutting or tearing rollers 1 to a collector and spreader mechanism comprising diverging channels and indicated generally at 3 which collects and locates the separated conductors in grooves 3*a* (FIG. 10), still covered by their insulation, in such a manner that the conductors are spread transversely as required and so as to facilitate removal of a short length of the insulation of the conductors to bare the ends thereof when fed between the jaws of a crop and strip mechanism 4 which at this stage is open to receive the spread apart conductors.

Figure 8:
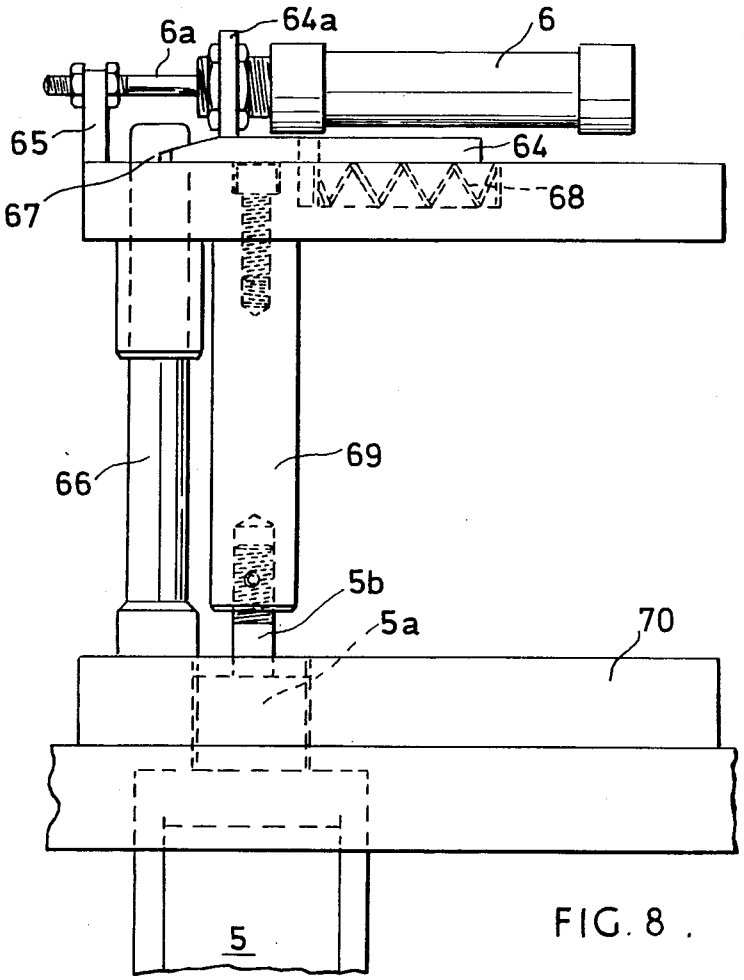
FIG. 8 is a part view showing the die set carring the cutting device and its latching and operating means in the closed position.
Figure 7:
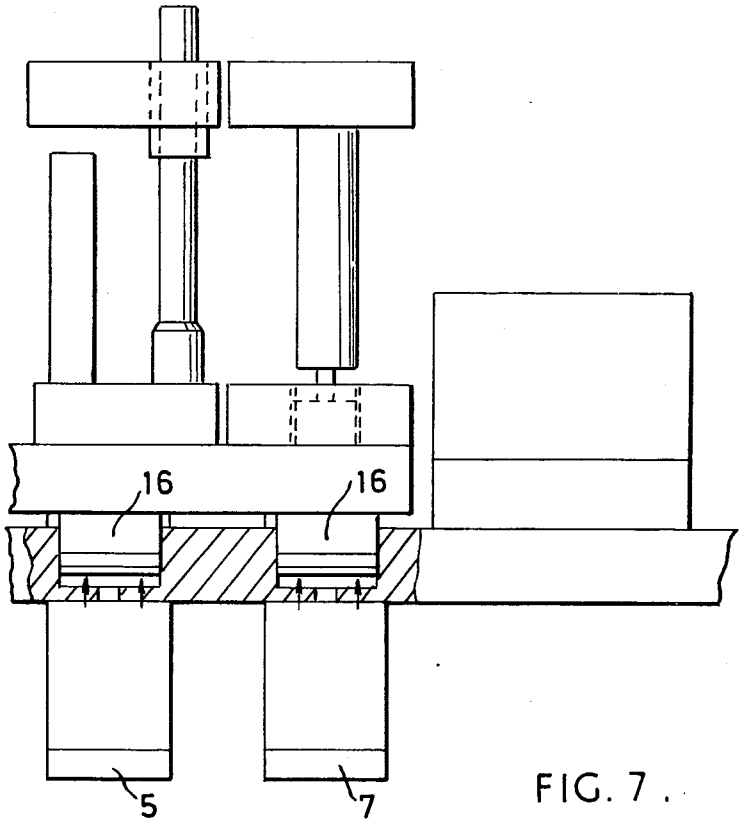
FIG. 7 is a view showing air springs against the influence of which moves a common base plate supporting the cutting or tearing device and conductor spreader mechanism.
Figure 9:
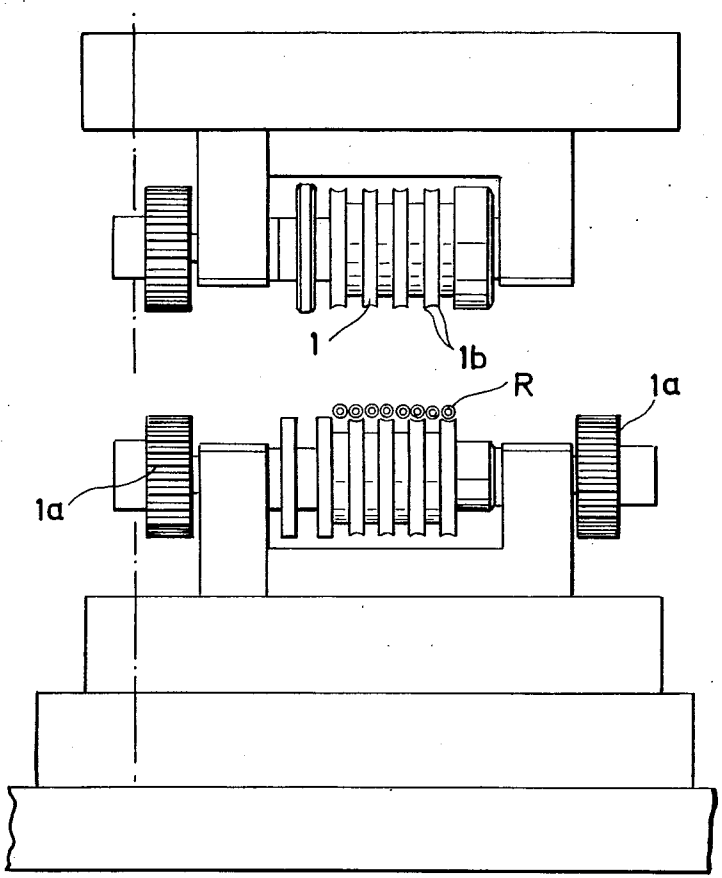
FIG. 9 is a part view showing the cutting or tearing device open to receive the ribbon cable.

At this position of the leading end of the cable R a pneumatic signal is initiated by the said rack 2*a* to operate fluid power cylinders 5 and 6 (FIGS. 1A, 7 and 8) to open the cutting or tearing rollers 1.

Figure 8A:
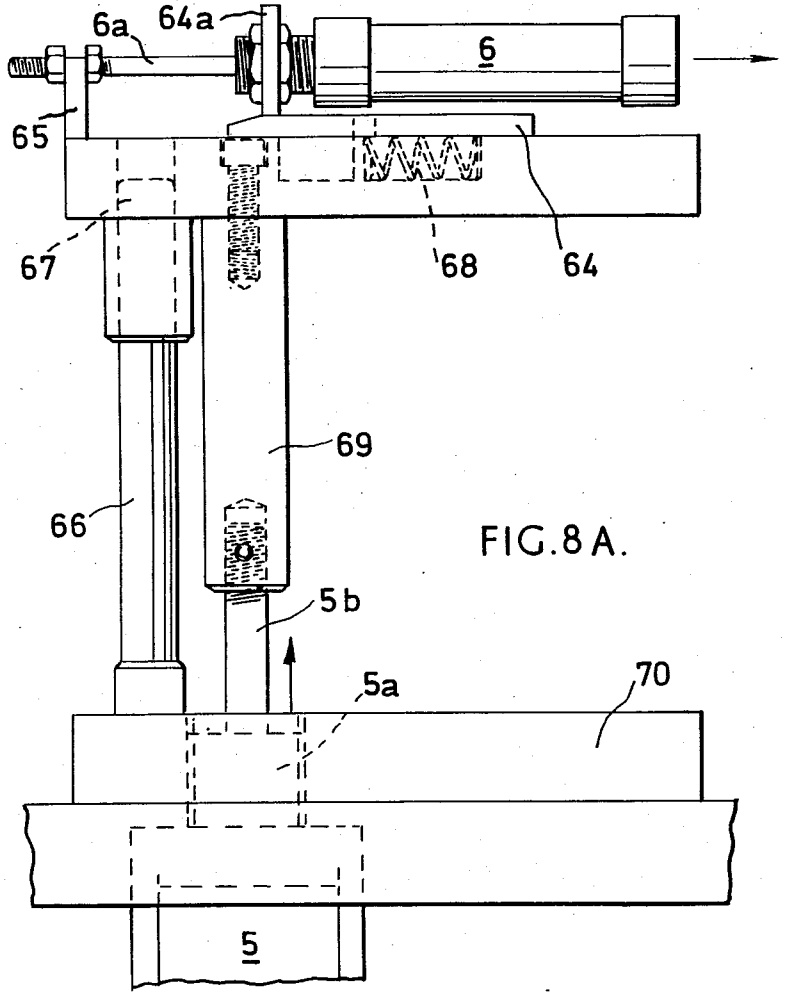
FIG. 8A is a view similar to FIG. 8 but in its open position.

The cutting or tearing device 1 comprises two sets of offset cutting or tearing rollers having peripheral teeth 1*b* which act to urge adjacent conductors in opposite directions thereby tearing the connection between adjacent connectors. This cutting or tearing device 1 is supported in a die set 70 (FIGS. 8 and 8A) which is mounted on the common base plate 15. The fluid power cylinder 5 is mounted by its screwed neck 5*a* into the base of the said die set 70 and the ram 5*b* is connected to the top of said die set 70 by a column 69. When a signal is initiated by the rack 2*a*, the cylinder 6, which is mounted on a vertical extension 64*a* of a latch 64, receives fluid, e.g. air, to the rear of its ram. As a ram 6*a* working in the cylinder 6 is constrained at its end by a vertical extension 65 of the die set it cannot advance and therefore pushes the cylinder 6 bodily rearwards (see FIG. 8A) against the influence of a spring 68 thus releasing the latch 64 from a notch 67 in the pillars 66. This allows the built-up pressure in the bottom of the cylinder 5 to exert itself and advance the ram 5*b* thus raising the top half of the die set and opening the top roller assembly to the full stroke of the cylinder 5. As this occurs a cam 10 of this assembly engages a pivoted lever 11 and swings the latter to cause the flat or formed face of a clamping element 12 thereof to bear on and grip the separated and spread insulated conductors which are now positioned in the crop and strip mechanism 4. The ram in the cylinder 2 then retracts to move the rack 2*b* back to its initial position ready for a subsequent operation and an electrical signal is given which causes a press 13 to operate one cycle during which the spread ends of the ribbon cable protruding beyond the front face of the spreader arrangement are cropped square to length and their insulation cut prior to stripping.

Figure 2B:
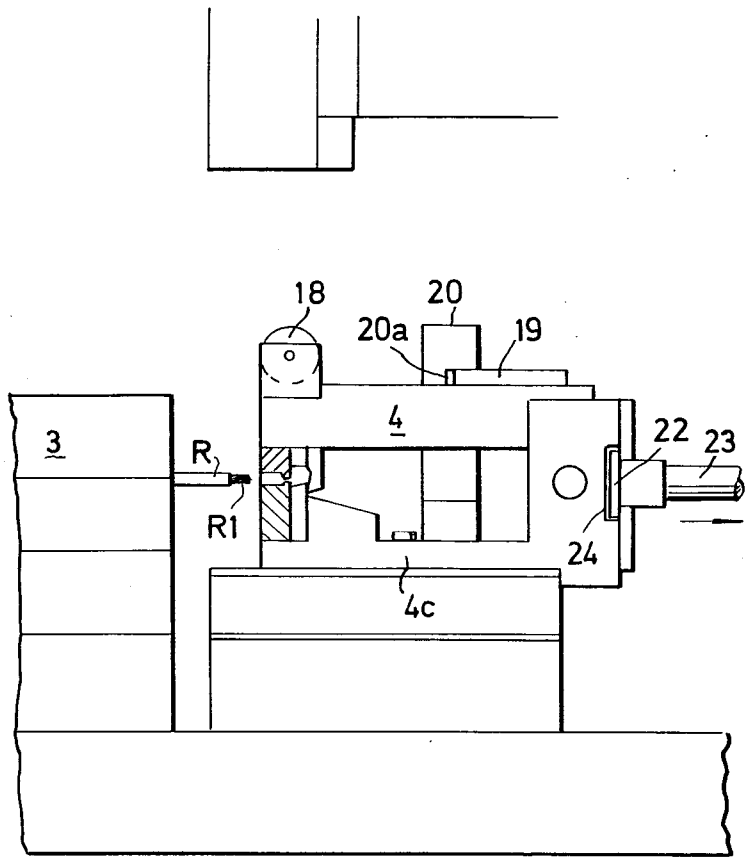
FIG. 2B is a view similar to FIG. 2A but showing the ribbon cable cropped to length and its insulation stripped with the crop and strip device in the closed end rearward position.
Figure 2A:
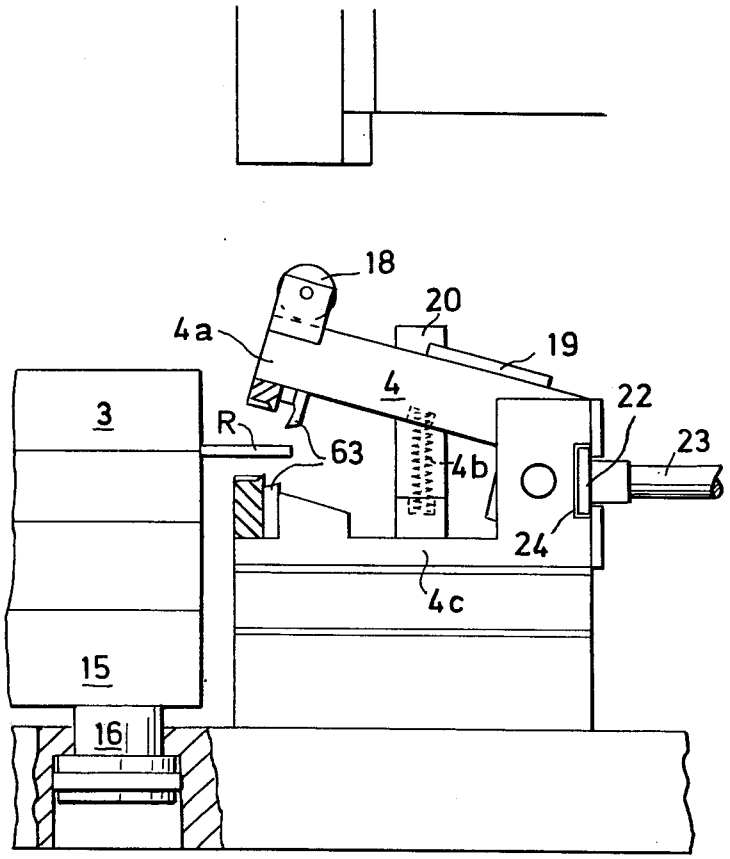
FIG. 2A is a view of part of FIG. 2 showing the ribbon cable protruding beyond the front face of the spreader mechanism and between the open jaws of the crop and strip device.

The cropping and stripping mechanism 4 comprises an upper part 4*a* which is swingable downwardly against the influence of springs 4*b* towards a lower part 4*c*, the springs 4*b* serving to return the part 4*b* upwardly when a control latch 19 is released. As illustrated in FIGS. 2A and 2B the former FIGURE shows the mechanism in the open position and FIGURES of the latch 19 are retained by the faces of the columns 20 to keep the latch 19 in the released position. On the downstroke of the press 13 a ram 17 strikes the roller assembly 18 carried by the top half 4*a* of the crop and strip mechanism and moves this top half downwards causing the latch 19 to engage in notches 20*a* under the pressure of the springs 20*b* (FIGS. 11 and 12).

Figure 13:
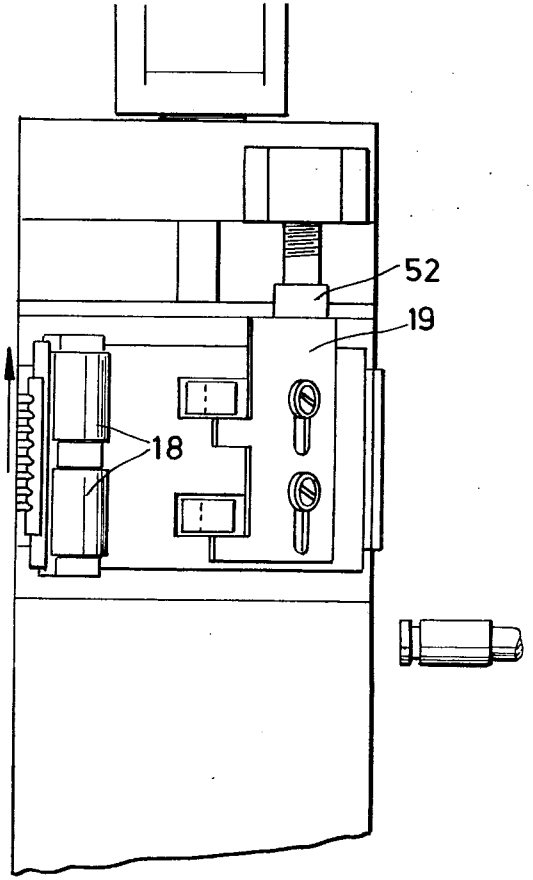
FIGS. 11, 12, and 13 are plan views of the crop and strip mechanism illustrating how a latch release mechanism controlling same is operated.
Figure 12:
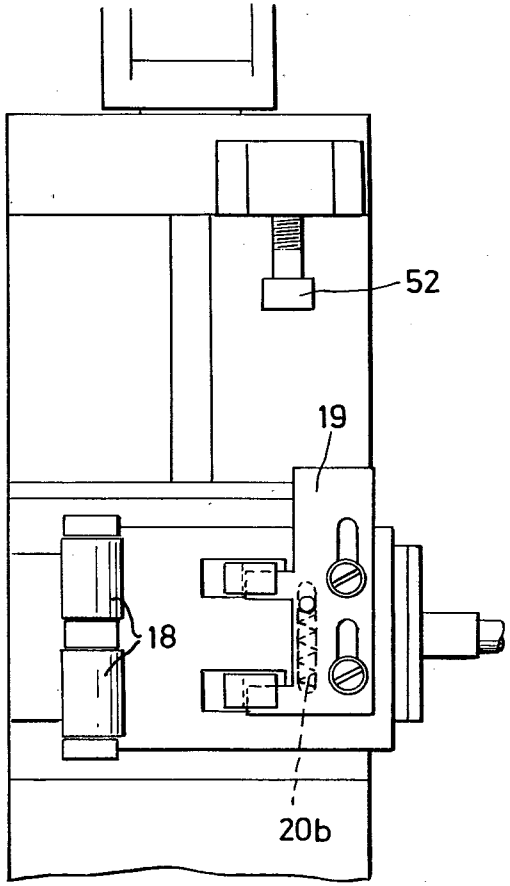
Figure 11:
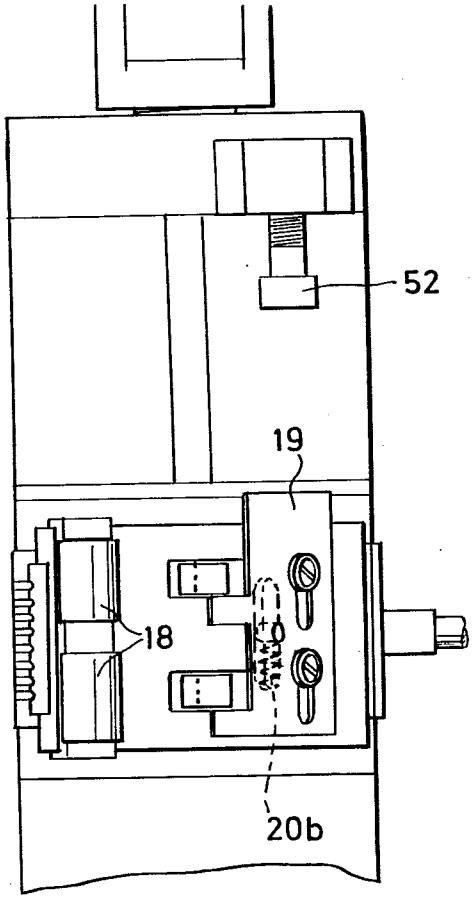

FIGS. 11, 12 and 13 illustrate how the latch 19 is released by the latter striking the latch release arm 52 when a transfer slide 26, referred to later, moves to bring the gang crimping tool under the press 13.

This cycle of operation effected by the press 13 is as follows:

During the downstroke of the press an extension arm 14 on the ram 17 (FIG. 2) engages the top of the spreader mechanism 3 and causes both the spreader mechanism 3 and the opened cutting or tearing roller assembly 1, when are mounted on a common base plate 15, to lower against the influence of air springs 16 (see also FIG. 7) to the down position. The ram 17 simultaneously strikes a roller assembly 18 which is carried on the top half 4*a* of the crop and strip mechanism 4 and moves this half of the mechanism downwards from an open position (FIGS. 1 and 2A) to a closed position (FIGS. 2 and 2B) wherein the blades 63 of the mechanism cut through the insulation and crops the end of the wire square and to the length required.

At this stage of the cycle of operations the latch 19 engages in the notches 20*a* in pillars 20 and locks the entire crop and strip mechanism in position.

On the upward return stroke of the press 13, the release of the arm 14 on the spreader mechanism 3 causes air pressure on the air springs 16 to return the opened cutting or tearing roller assembly 1 and spreader mechanism 3 mounted on the common base plate 15, to the up position and a signal is given to cause a ram 23 in a cylinder 21 (FIGS. 1, 2A and 2B) to retract and move rearwardly into the cylinder 21 to actuate the insulation stripping mechanism to strip the cut insulation from the conductor ends to bare by means of the blades 63, the cores or wire R1 thereof (see FIG. 2B). This is achieved by way of a tennoned adapter 22 attached to a protruding end of a ram rod 23, the adaptor 22 being engaged with a complementary tennon slot 24 to the rear of the lower half 4C of the crop and strip mechanism 4.

Figure 4:
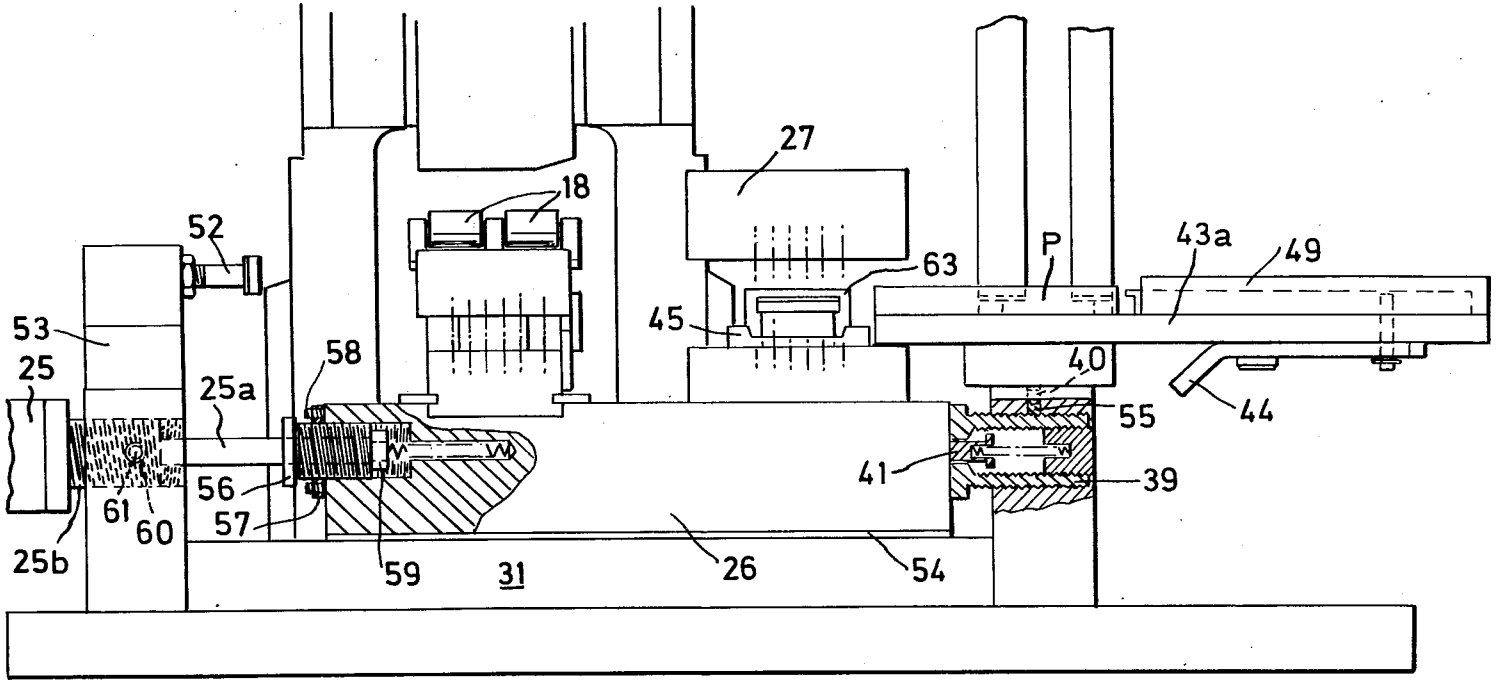
FIG. 4 is a front view of the transfer mechanism detailing its positioning means and generally including the crop and strip device, the gang crimping mechanism and a supply magazine for holders with contacts fitted therein in preliminary positions.
Figure 4A:
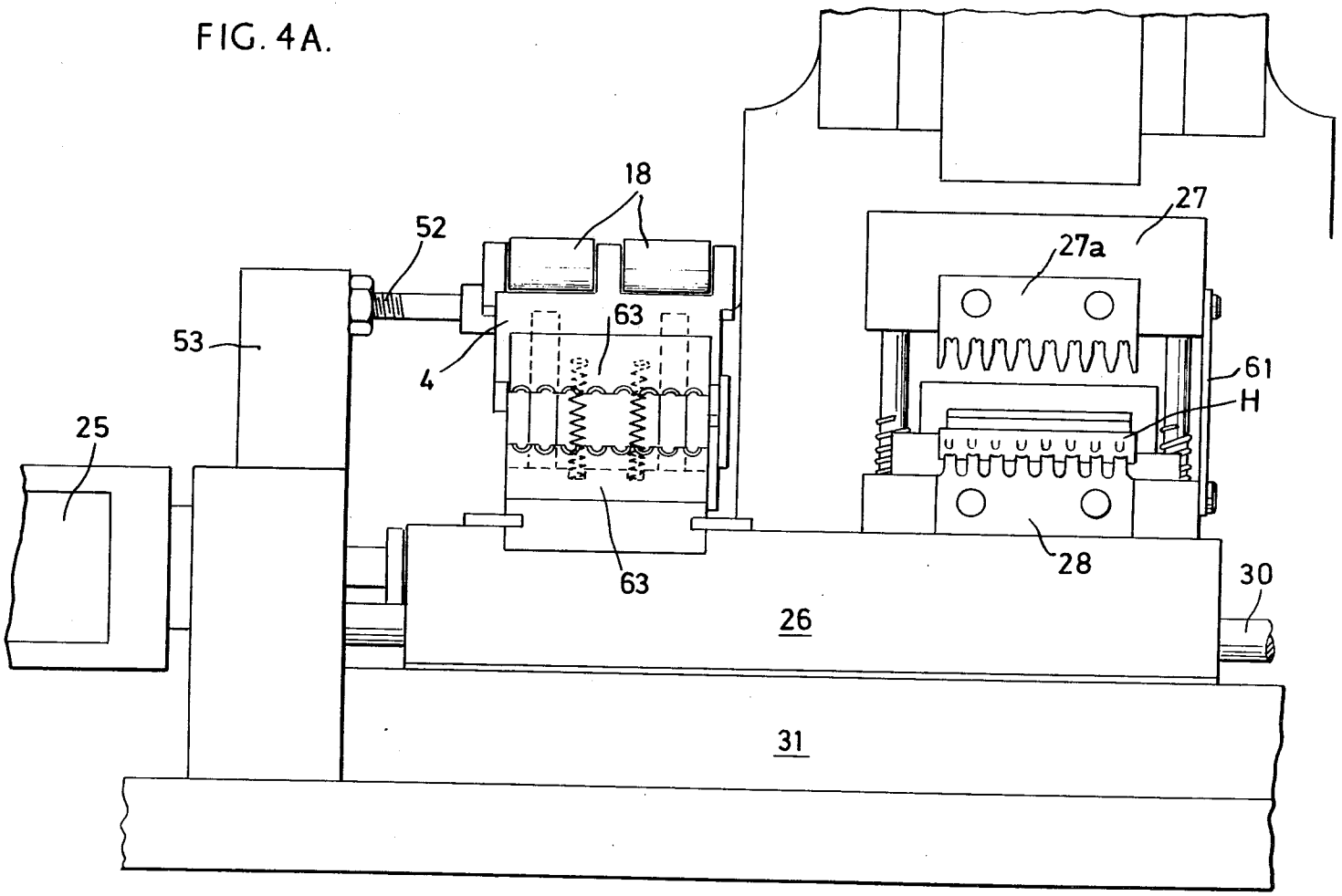
FIG. 4A is a view similar to FIG. 4 but showing the crop and strip device and gang crimping means in detail.

At this stage of the cycle of operations a further signal is given which results in reverse operation of a ram in a cylinder 25 (FIG. 4) and a transfer slide 26 actuated thereby is moved in an opposite direction and the crop and strip mechanism 4 and a crimping tooling 27 (see also FIGS. 3 and 4A) carried on this slide 26 is moved into a position directly under the press 13, at the same time causing the latch 19 to strike the latch release arm 52 carried on a column 53, thus releasing the latch against spring pressure allowing the crop and strip mechanism to open.

Figure 5:
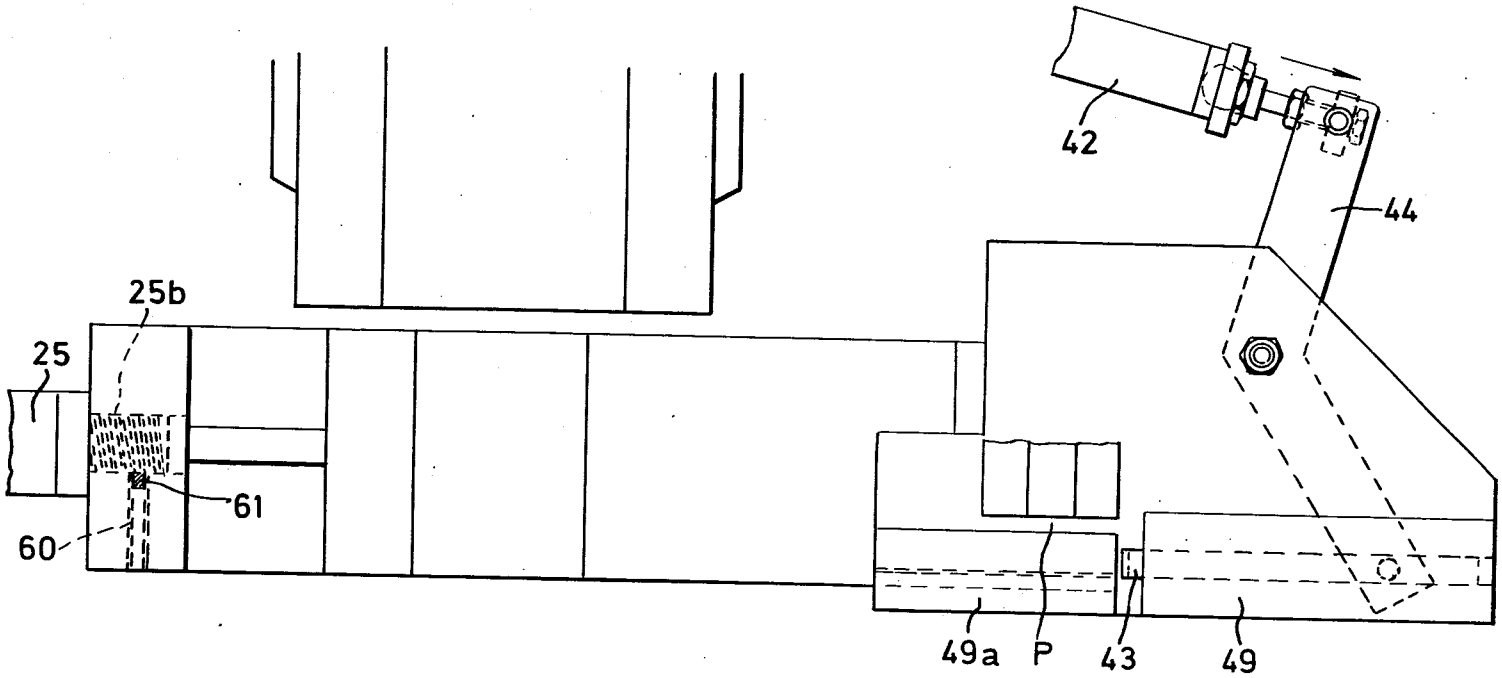
FIG. 5 is a part plan view of FIG. 4.

The transfer slide 26 is slidable on two ground rods 29, 30 (FIG. 6) by a ram 25*a* of the cylinder 25 and also slides on a U-shaped prefabricated base 31 the top surface of which is covered with a load taking bearing strip 54. Each rod 29 and 30 is located in a hole 33, said rods each having a flat 32 and being secured in the holes by screws 34. The slide 26 can be adjusted for position by a screwed adjusting bush 56 (FG. 4), and rotation of this bush 56 is constrained linearly by a collar 59 attached to the end of the ram rod 25*a* of the cylinder 25 and causes the slide 26 to adjust its position. Locking of the slide 26 in its required set position is effected by means of a locking collar 57 and locking screws 58. The cylinder 25 is mounted by its screwed neck 25*b* directly into the side member of the U-shaped prefabricated base 31 and is secured in position and prevented from rotating by a locking screw 60 and plug 61 (FIG. 5).

The other end of the slide 26 is provided with a simple screwed bush 39 fitted with a locking screw 40 and a plug 55 and a spring loaded plunger 41 is fitted on the bush 39 and the end of this plunger 41 projects beyond the stop face of the bush to provide a cushioning effect.

The required number of contacts C for each cable are fitted in initial and temporary positions in a socket housing H (FIG. 6) and the housings with their contained contacts present themselves to a position P (FIGS. 4 and 5) from a magazine slide S (FIG. 6) and are then moved by means of a second slide 43 (constrained within slide cover 49 and its extension 49*a*) and slidable on a base 43*a*, operated by a bell crank lever 44 actuated by a ram and cylinder assembly 42 to a locating nest 45 (FIGS. 3 and 4) and in position on to the lower crimp die 28 (FIG. 3). This operation takes place immediately the cycle is initiated and whilst the ribbon wire R is passing through the pair of cutting or tearing rollers 1 and into the spreader mechanism 3.

When the transfer slide 26 supports a housing H and its contacts or connectors in a crimping position under the press 13, an electrical signal is given to operate the press one cycle to gang-crimp the contacts to the bared ends R1 of the conductors. On the down stroke of the press 13 the extension arm 14 on the ram 17 (FIG. 2) moves the spreader assembly 3 and the open cutting or tearing roller assembly 1 mounted on said common base plate 15 downwardly against air spring cylinders 16 and engages the prepared ends R1 of the ribbon wire beyond the front face of the said spreader assembly in the crimp portions of the connectors of contacts in a socket housing H which has already been positioned at P on to the lower crimp die 28. At the same time the ram 17 moves the top half of the crimping tool 27, carrying the crimping punch 27*a* downwards to effect gang-crimping of the contacts to the bared ends R1 of the conductor wires. On the upward return stroke of the press 13 the top half of the crimping tool 27 is raised under spring pressure to a pre-set open height governed by a slotted arm 62 (FIG. 3). On this return stroke of the press 13 a signal is given which charges air to the underside of the built in air cylinder 46 (FIG. 3) to lift the socket housing H and the locating nest 45 to a position in readiness for closing the crimped contacts into their housing. At the same time the release of the extension arm 14 on the spreader mechanism 3 causes pressure on the air springs 16 to return the cutting roller assembly 1 and spreader mechanism 3 mounted on the common base plate 15 to the up position. When both these operations are achieved a further signal results in operation of the ram 23 in the cylinder 21 and the front face of the tennon adapter 22 engages the spring returned pusher 41 through the locating nest housing 63 and forces the socket housing H forward until the crimped contacts are pushed completely into the said housing. The projection 41*a* of the front face of the pusher 41 prevents the socket housing from tilting during this operation. A signal is then given which results in reverse operation of the ram 23 of the cylinder 21, to remove air from the underside of the built in air cylinder 46 which allows compression springs 47 contained within the locating nest assembly, to exert themselves and return the locating nest downward to the rest position, at the same time operating cylinder 7 which opens the spreader mechanism 3, thus allowing the completed crimped and closed socket housing H assembly to be removed from the machine, leaving the machine ready for the next cycle.

According to modifications not illustrated the ribbon cable may be moved and conveyed to the connectors and socket housing in any other suitable manner, and crimping of the connectors may be effected singly instead of simultaneously by indexing the cylinder forwardly.

What we claim is:

1. A machine for fitting insulated conductors of an enlongated, multi-conductor ribbon, electric cable with contacts comprising:

a. separator means for severing the individually insulated conductors at the leading end of said cable;
b. guide means for guiding said cable lengthwise to said separator means;
c. spreading means for transversely spreading the severed conductors;
d. stripping means adapted to receive the spread conductors for baring the leading ends of the same;
e. moving means for withdrawing said cable from said separator means and for locating the leading ends of the spread conductors in said stripping means while holding the conductors stationary;
f. feeding means for feeding a housing containing a plurality of contacts to a position wherein said contacts are adjacent respetive ones of the leading ends of the conductors bared by said stripping means;
g. engaging means for engaging the adjacent contacts with the bared leading ends of said conductors respectively.

2. A machine as set forth in claim 1, wherein said separator means include two rollers having respective axes and formed with radial projections and recesses, shifting means for shifting said rollers toward and away from a position of interengagement of the projections on each roller with the recesses of the other roller, and drive means for rotating the rollers while in said position, said guide means including means for guiding said cable toward a position intermediate said rollers for simultaneous engagement by the projections of each roller.

3. A machine as set forth in claim 2, wherein said drive means include a coaxial pinion on one of said rollers, a rack meshing with said pinion, and fluid-operated ram means for reciprocating said rack.

4. A machine as set forth in claim 3, wherein said spreading means define a plurality of channels diverging from said separator means toward said stripping means, and said moving means include means for moving said leading ends in said channels respectively.

5. A machine as set forth in claim 4, wherein said moving means further include a clamping member and cam means responsive to the shifting of said rollers for clampingly engaging said clamping member with said conductors and for thereby holding the same stationary.

6. A machine as set forth in claim 1, wherein said stripping means include a plurality of cutting blades, and operating means for moving said blades into cutting engagement with the spread and severed insulated conductors.

7. A machine as set forth in claim 1, wherein said engaging means include crimping means for crimping said contacts on the engaged bared ends of respective conductors.

8. A machine as set forth in claim 1, further comprising electrically controlled, fluid-operated means for actuating said separator means, said spreading means, said stripping means, said moving means, said feeding means, and said engaging means in timed sequence.

* * * * *